US009682394B2

(12) United States Patent
Müller et al.

(10) Patent No.: US 9,682,394 B2
(45) Date of Patent: Jun. 20, 2017

(54) DISPENSING MODULE, APPLICATOR HEAD AND NOZZLE HOLDER FOR DISPENSING A FLUID, IN PARTICULAR HOT-MELT ADHESIVE

(71) Applicant: Nordson Corporation, Westlake, OH (US)

(72) Inventors: Manfred Müller, Glienitz (DE); Wolfgang Marx, Hitzacker (DE)

(73) Assignee: NORDSON CORPORATION, Westlake, OH (US)

( * ) Notice: Subject to any disclaimer, the term of this patent is extended or adjusted under 35 U.S.C. 154(b) by 142 days.

(21) Appl. No.: 14/354,368

(22) PCT Filed: Oct. 17, 2012

(86) PCT No.: PCT/IB2012/002149
§ 371 (c)(1),
(2) Date: Apr. 25, 2014

(87) PCT Pub. No.: WO2013/064876
PCT Pub. Date: May 10, 2013

(65) Prior Publication Data

US 2014/0299680 A1 Oct. 9, 2014

(30) Foreign Application Priority Data

Oct. 31, 2011 (DE) ..... 20 2011 107 265 U

(51) Int. Cl.
*B05B 1/30* (2006.01)
*B05C 5/02* (2006.01)
*B05B 15/06* (2006.01)

(52) U.S. Cl.
CPC ..... *B05C 5/0225* (2013.01); *B05B 1/306* (2013.01); *B05B 1/3046* (2013.01); *B05B 15/065* (2013.01)

(58) Field of Classification Search
CPC ..... B05C 5/02–5/0229; B05C 5/0237; B05B 1/3046; B05B 1/306; B05B 15/065; Y10T 156/1798; F02M 61/08
(Continued)

(56) References Cited

U.S. PATENT DOCUMENTS 4,759,477 A 7/1988 Gelinas et al.
4,907,741 A * 3/1990 McIntyre ..... B05B 7/0475 239/124
(Continued)

FOREIGN PATENT DOCUMENTS

DE 29622341 U1 4/1997
DE 10010952 A1 9/2001
(Continued)

OTHER PUBLICATIONS

European Patent Office, International Search Report and Written Opinion in PCT/IB2012/002149, Dec. 20, 2012.
(Continued)

*Primary Examiner* — Arthur O Hall
*Assistant Examiner* — Juan C Barrera
(74) *Attorney, Agent, or Firm* — Baker & Hostetler LLP

(57) ABSTRACT

The invention relates to a dispensing module (1) for an applicator head for dispensing a fluid, in particular hot-melt adhesive, comprising a module housing (5), a valve body accommodated in the module housing (5), an adapter (7) through which the valve body extends, comprising a proximal end (49) and a distal end (41), the distal end (41) being connected by means of a screw connection (51) to the module housing (5), a nozzle holder (9) which is adapted to be inserted into a matching recess in a base member of the applicator head, and one or a plurality of sealing elements (57, 59, 61) for sealing the nozzle holder (9) and the base member against each other in a fluid-tight manner. Accord-
(Continued)

Figure 1:
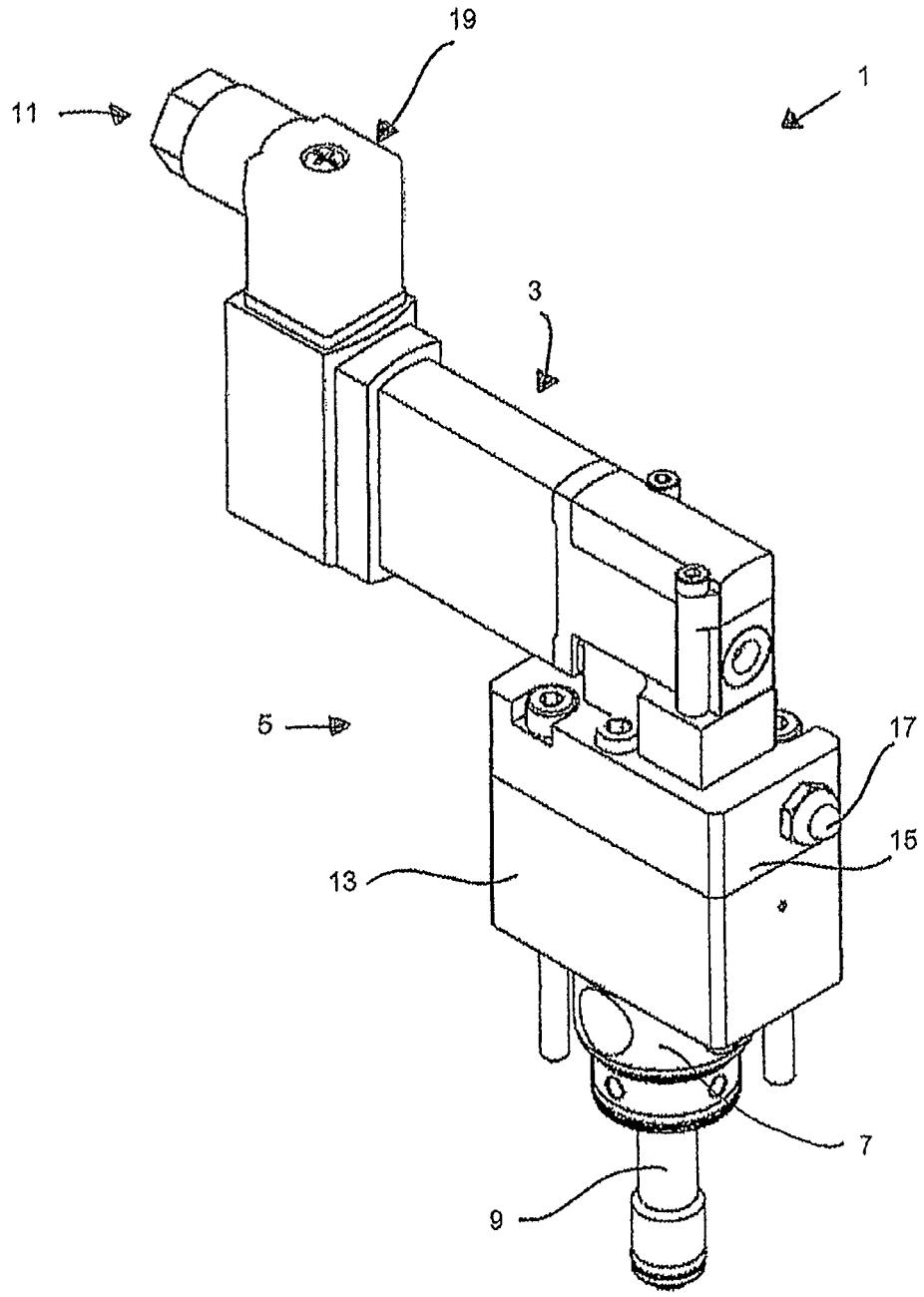

ing to the invention, it is proposed that the nozzle holder (9) comprises a cavity (69) through which the valve body extends, is connected by means of a screw connection (51) to the proximal end (49) of the adapter (7), comprises a valve seat (79) which is adapted to cooperate with a valve head (31) of the valve body, and comprises an elongate section (75) upstream from the valve seat (79), within which the cavity (69) is limited to a narrow gap (77).

10 Claims, 5 Drawing Sheets

(58) Field of Classification Search
USPC ..... 239/548, 504, 559, 295, 578, 585.4, 239/585.5, 569, 533.7, 533.1–533.12, 239/583, 584
See application file for complete search history.

(56) References Cited

U.S. PATENT DOCUMENTS 6,164,568 A * 12/2000 Muller ..... B05C 5/0237 239/584
6,669,057 B2 12/2003 Saidman et al.
7,147,136 B2 * 12/2006 Burmester ..... B05C 5/0225 222/333
2007/0029036 A1 * 2/2007 Fort ..... B65C 9/2208 156/291
2011/0315232 A1 * 12/2011 Crowell ..... B05C 5/0225 137/14

FOREIGN PATENT DOCUMENTS

| | | | |
|---|---|---|---|
| EP | 0286212 | A2 | 10/1988 |
| EP | 0565972 | A1 | 10/1993 |
| EP | 1147820 | A2 | 10/2001 |
| EP | 1308217 | A2 | 5/2003 |
| JP | 63315168 | | 12/1988 |
| JP | 200252351 | | 2/2002 |
| JP | 2002361122 | A | 12/2002 |
| JP | 2003164792 | A | 12/2003 |
| WO | 2007005396 | A1 | 1/2007 |

OTHER PUBLICATIONS

European Patent Office, Written Opinion of the International Preliminary Examining Authority in PCT/IB2012/002149, Nov. 29, 2013.
Japanese Application No. 2014-539416: Reasons for Refusal dated Jun. 27, 2016, 4 pages.
Chinese Patent Application No. 201280053658.8: Third Office Action dated Feb. 15, 2017, 9 pages.

* cited by examiner

DISPENSING MODULE, APPLICATOR HEAD AND NOZZLE HOLDER FOR DISPENSING A FLUID, IN PARTICULAR HOT-MELT ADHESIVE

The present invention concerns a dispensing module for an applicator head for dispensing a fluid, in particular hot-melt adhesive.

The invention further concerns a nozzle holder for such a dispensing module and an applicator head having such a module.

The above-mentioned units are used in all areas of industry when fluids, in particular adhesives, have to be applied to substrates by means of applicator heads. For that purpose, the applicator heads usually have especially shaped nozzles. These can be nozzles which are of a slit-shaped or slot-shaped nozzle geometry, individual (spray) nozzles or a plurality of intermittently arranged nozzle openings. Depending on the respective area of use, application by means of the applicator heads is effected in contact with the substrate or in contact-free relationship. In the course of the past years the need for systems affording high operational efficiency has progressively increased. In that way the development of ever more powerful systems has been driven onward, which on the one hand are intended to ensure application as precise as possible, and which on the other hand are intended to operate at high speed and with the lowest possible consumption of adhesive. In that respect, a particular requirement involves the intermittent application of adhesive. The latter is effected for example by means of valves which can be rapidly switched, for example by using solenoid valves.

Systems of the general kind set forth are available for example under the product line Speed-Coat™ of the present applicant Nordson Corporation.

While the known systems already provide entirely satisfactory working results and are operated with a high level of reliability, there is however a need for improvement in regard to adjustability of the valves used in the modules. When using rapidly operable modules, valves with an elongate valve body are usually employed, which move away from their valve seat into an open position by a given stroke travel and then return to a closed position again. The precise length of the stroke is very difficult to adjust in practice and certain adjustment tolerances have to be accepted. The tolerance in terms of fluid dispensing behaves in a similar manner to the setting of that stroke tolerance. In other words, the occurrence of fluctuations in the fluid discharge has to be accepted.

Taking that as the basic starting point, the object of the present invention is to provide a dispensing module, a nozzle holder and an applicator head, which achieve an increase in application quality even at a high cycle rate for the valve used.

The invention attains its object in a dispensing module of the kind set forth in the opening part of this specification, with the features of claim 1. The dispensing module according to the invention for an applicator head for dispensing a fluid, in particular hot-melt adhesive, comprising a module housing, a valve body accommodated in the module housing, an adapter through which the valve body extends, comprising a proximal end and a distal end, the distal end being connected by means of a screw connection to the module housing, a nozzle holder which is adapted to be inserted into a matching recess in a base member of the applicator head, and one or a plurality of sealing elements for sealing the nozzle holder and the base member against each other in a fluid-tight manner, wherein the nozzle holder comprises a cavity through which the valve body extends, is connected by means of a screw connection to the proximal end of the adapter, comprises a valve seat which is adapted to cooperate with a valve head of the valve body, and comprises an elongate section upstream from the valve seat, within which the cavity is limited to a narrow gap.

The invention makes use of the realisation that the flow characteristics within the nozzle holder upstream of the valve and directly at the valve have a decisive influence on the fluid flow passing between the valve seat and the valve head. The amount of fluid passing between the valve seat and the valve head crucially depends on the pressure drop produced by opening of the valve. In the case of the known dispensing systems, because of the adjustment tolerances of the valve stroke, tolerances occurred in terms of the opening diameter of the valve, which similarly led to fluctuations in pressure drop caused by the varying opening diameter between the valve seat and the valve head and thus also fluctuations in the fluid discharge. Because in accordance with the invention, however, upstream of the valve seat there is provided an elongate section within which the cavity is limited to a narrow gap, the crucial pressure drop is now no longer created directly in the opening between the valve seat and the valve head, but already occurs when flowing through the narrow gap. The longer and narrower the gap is, the greater is the corresponding pressure drop which has occurred until reaching the opening cross-section between the valve seat and the valve head. The consequence of this is that fluctuations in pressure drop, having been possibly caused in addition by an inconstant or excessively short stroke of the valve head from the valve seat are scarcely crucial or are not crucial at all. Thus, the fluid discharge is decisively determined by the length and narrowness of the gap but not by the exact setting of the stroke movement of the valve. Thus, extremely precise adjustment of the valve stroke becomes substantially redundant and/or the number of switching cycles, after the attainment of which re-adjustment of the valve becomes necessary, is drastically reduced. The size of the gap defining the pressure drop in the elongate section can be produced and predicted with a high level of precision and involving less time involvement than would be possible by way of (fine) adjustment of the stroke while fitting the valve piston in the module.

An advantageous development of the invention provides that the elongate section is of a length which is a multiple of the width of the narrow gap. The length of the elongate gap preferably is in a range of 14 to 20 times the width of the gap. Particularly preferred, the length of the elongate gap is 15 times the width of the gap.

The width of the narrow gap is preferably in a range of 0.3 mm to 0.7 mm. Particularly preferred the width of the narrow gap is 0.5 mm.

The combination of the aforementioned preferred ranges of values for the length and width of the gap in the elongate region represents an unexpectedly good compromise for a large number of fluids, in particular for a large number of hot-melt adhesives. Because of the greatly differing fluid characteristics even under similar pressure and/or temperature conditions, a particularly advantageous configuration is one with which a plurality of fluids can be satisfactorily conveyed, without a respective separate implementation of the valve geometry having to be provided.

In an advantageous development the elongate section is arranged adjacent the valve seat. Although it also alternatively appears to be possible for the elongate section to be arranged further upstream than directly adjoining the valve seat, the positional combination of the narrow gap and the valve seat is deemed to be advantageous to minimise additional fluidic effects which could otherwise occur between the elongate region with the narrow gap and the valve seat.

In a preferred embodiment the valve piston is movable between a closed position in which the valve head is in fluid-tight contact with the valve seat and an open position, and the closed position and the open position are spaced from each other by a stroke X. Preferably the opening cleared by means of the stroke X is larger than that of the narrow gap. The larger the opening cleared by the stroke X in relation to the cleared cross-section in comparison with the narrow gap, the correspondingly less is the influence of the precise size of the stroke on the pressure drop produced. The size of the stroke X upwardly is in principle unlimited and is at most limited by the required cycle frequency of the module or valve. Preferably the magnitude of the stroke X is 0.3 mm or less. That ensures operation with a high cycle frequency and at the same time there is a sufficiently large opening between the valve seat and the valve head so that the influence on the pressure drop remains low.

The valve seat preferably has a seat surface with an aperture angle $\alpha$ in a range of 120° to 140°, preferably 124°. The larger the aperture angle $\alpha$, which is equivalent to a progressively flatter conical configuration for the end face of the valve seat, the correspondingly greater is the increase in the cleared opening when the stroke movement is performed between the closed position and the open position. In that respect the internal width between the surface of the valve seat and the corresponding surface of the valve head is decisive.

Preferably, alternatively or additionally, the valve head has a surface matching the seat surface of the valve seat, with an aperture angle between 120 and 140, preferably 120°.

In a further preferred embodiment the adapter comprises a positioning element, preferably a centering shoulder, at its distal end, and the module housing comprises a corresponding positioning element, preferably a centering bore. The term 'distal' in the context of this application is used to mean the side or orientation of the adapter facing away from the valve opening in the condition of being fitted ready for operation. As a counterpart the term 'proximal' is used to mean the side of the adapter facing towards the valve opening in the operationally correct fitted position.

Preferably at the proximal end the adapter comprises a positioning element, preferably a centering shoulder, and the nozzle holder comprises a corresponding positioning element, preferably a centering bore.

In a further advantageous development of the dispensing module, two O-rings rings are arranged as sealing elements along the periphery of the nozzle holder, and an axial and/or cone-shaped sealing element is disposed at a flange portion of the nozzle holder, the O-ring being configured to seal against a matching cylindrical surface of the recess accommodating the nozzle holder and the axial and/or conical sealing element for sealing against a matching surface or edge of the recess accommodating the nozzle holder. The above-described combination of various sealing elements combines an altogether excellent sealing property with a simple and inexpensive structure and fitment capability, and this provides that the external environment of the nozzle holder which in the mounted condition is the recess accommodating same in the applicator head can be reliably and permanently kept free from fluid.

In a further advantageous embodiment of the invention, the valve body is fixed to a valve piston by means of a screw connection. Preferably the piston comprises a threaded portion produced by means of thread forming, and/or the threaded bore corresponding to the threaded portion of the valve piston is produced by means of thread forming. That achieves an increase in the thread strength which affords a longer service life or longer maintenance intervals for the dispensing module. The threaded portion of the valve body and the corresponding threaded bore preferably have a reduced thread pitch. That permits adjustment of the valve body more precisely, even if only limitedly necessary according to the invention. What is still relevant is adjustment of the position of the valve piston to make the minimum stroke sufficiently large. When that is achieved, as described above, the influence of the stroke on the pressure drop which is decisive in terms of fluid discharge is minimised.

The object of the invention is further attained in relation to a nozzle holder of the kind set forth in the opening part of this specification, which is adapted to be inserted into a corresponding recess of a base member of the applicator head and which comprises a cavity through which the valve body extends, is connected by means of a screw connection to the proximal end of the adapter, comprises a valve seat adapted to co-operate with a valve head of the valve body, and comprises an elongate section upstream of the valve seat, within which the cavity is limited to a narrow gap.

Advantageous embodiments of the nozzle holder will be apparent from the foregoing description relating to the preferred embodiments of the dispensing module according to the invention (to which reference is made in the full entirety thereof).

In addition the object of the invention is attained in relation to an applicator head of the kind set forth in the opening part of this specification, which comprises a base member having a recess, one or a plurality of flow channels connected in fluid communication with the recess, one or a plurality of dispensing orifices connected in fluid communication to the one or the plurality of flow channels, and a dispensing module according to one or more of the preferred embodiments of the present invention, comprising a nozzle holder according to the present invention, which is inserted into the recess in such a way that the one or plurality of dispensing orifices are connected in fluid communication to the cavity of the nozzle holder when the valve is in an open position. Advantages and further configurations of the applicator head according to the invention will also be apparent from the embodiments described hereinbefore of the nozzle holder according to the invention and the dispensing module according to the invention, in which respect attention is directed to that description in its full entirety.

Figure 2:
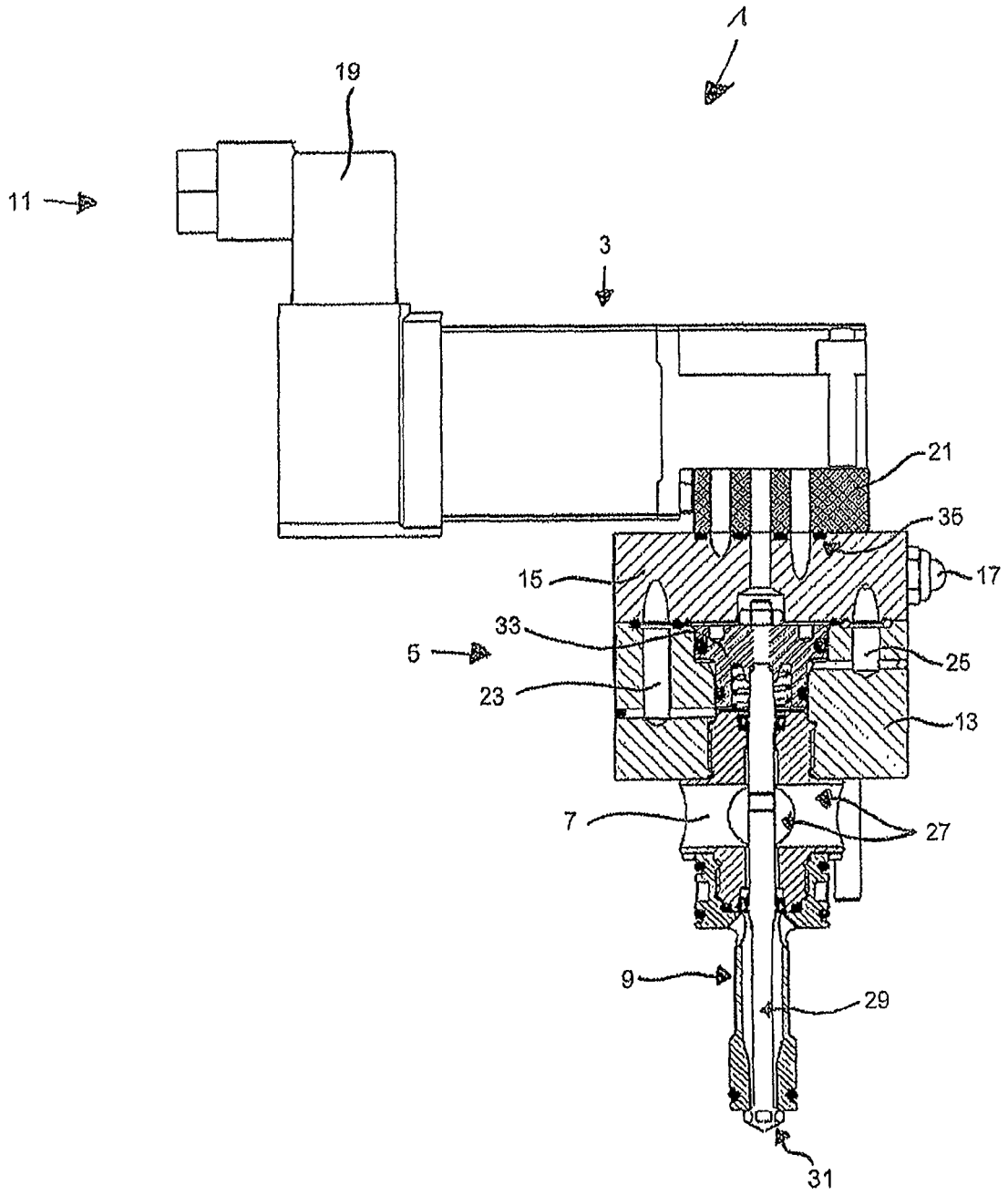
Figure 3:
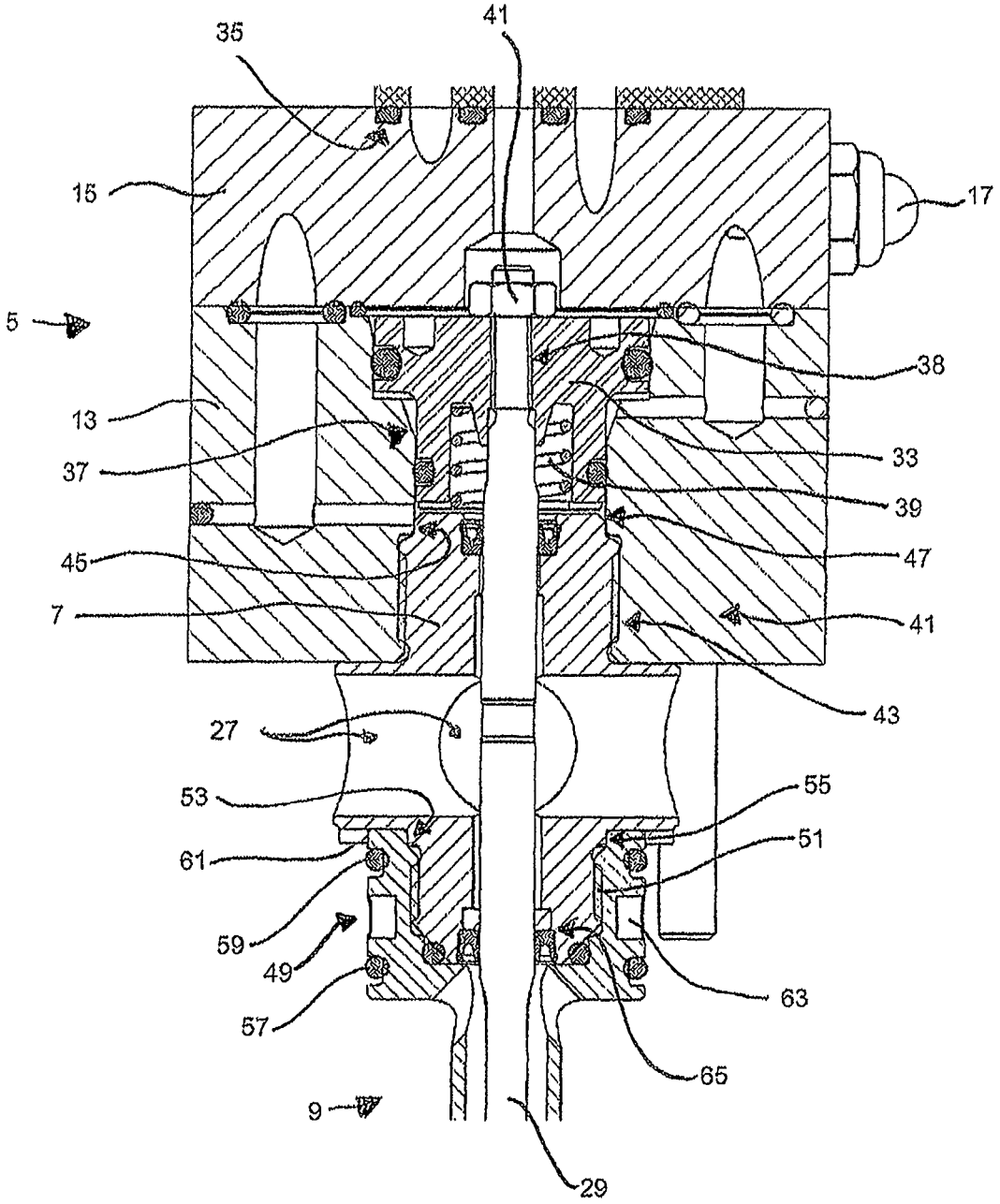
Figure 4:
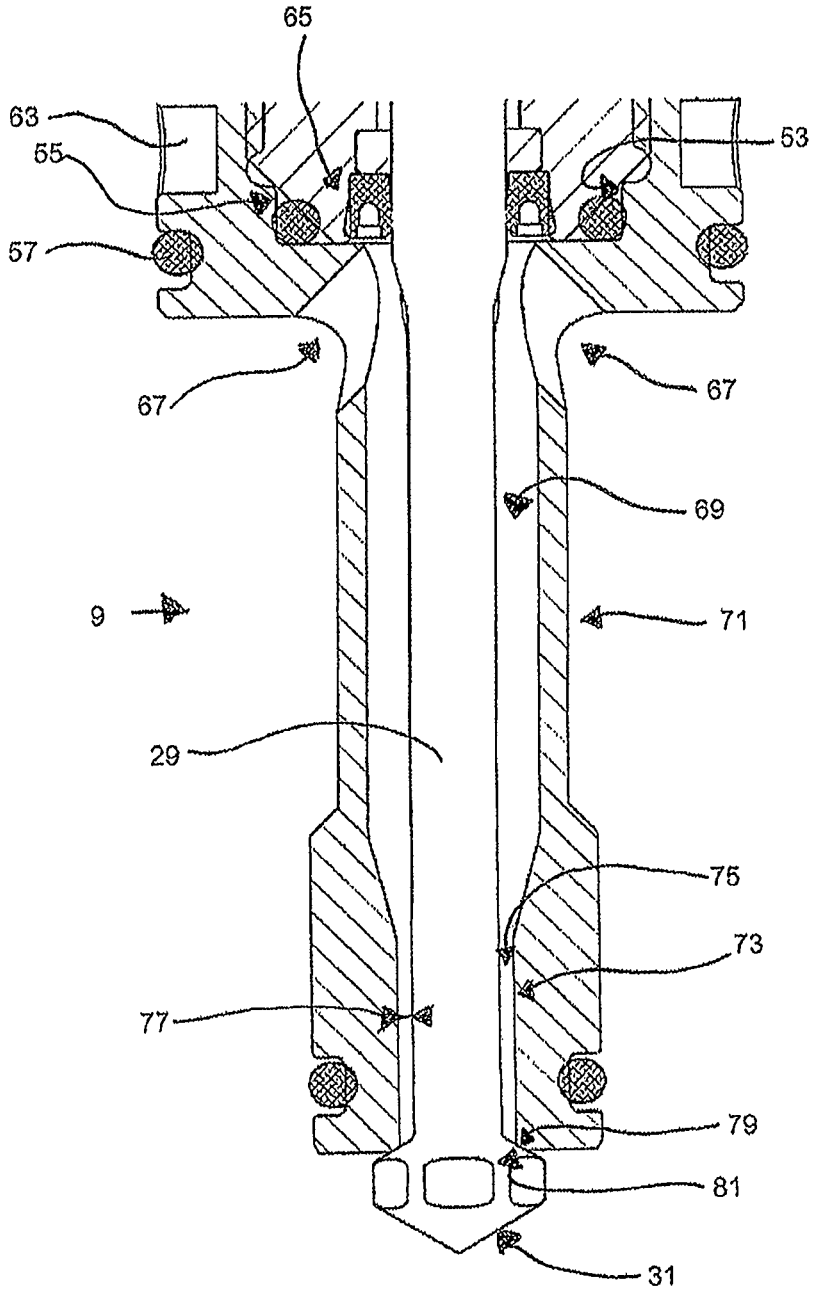
Figure 5:
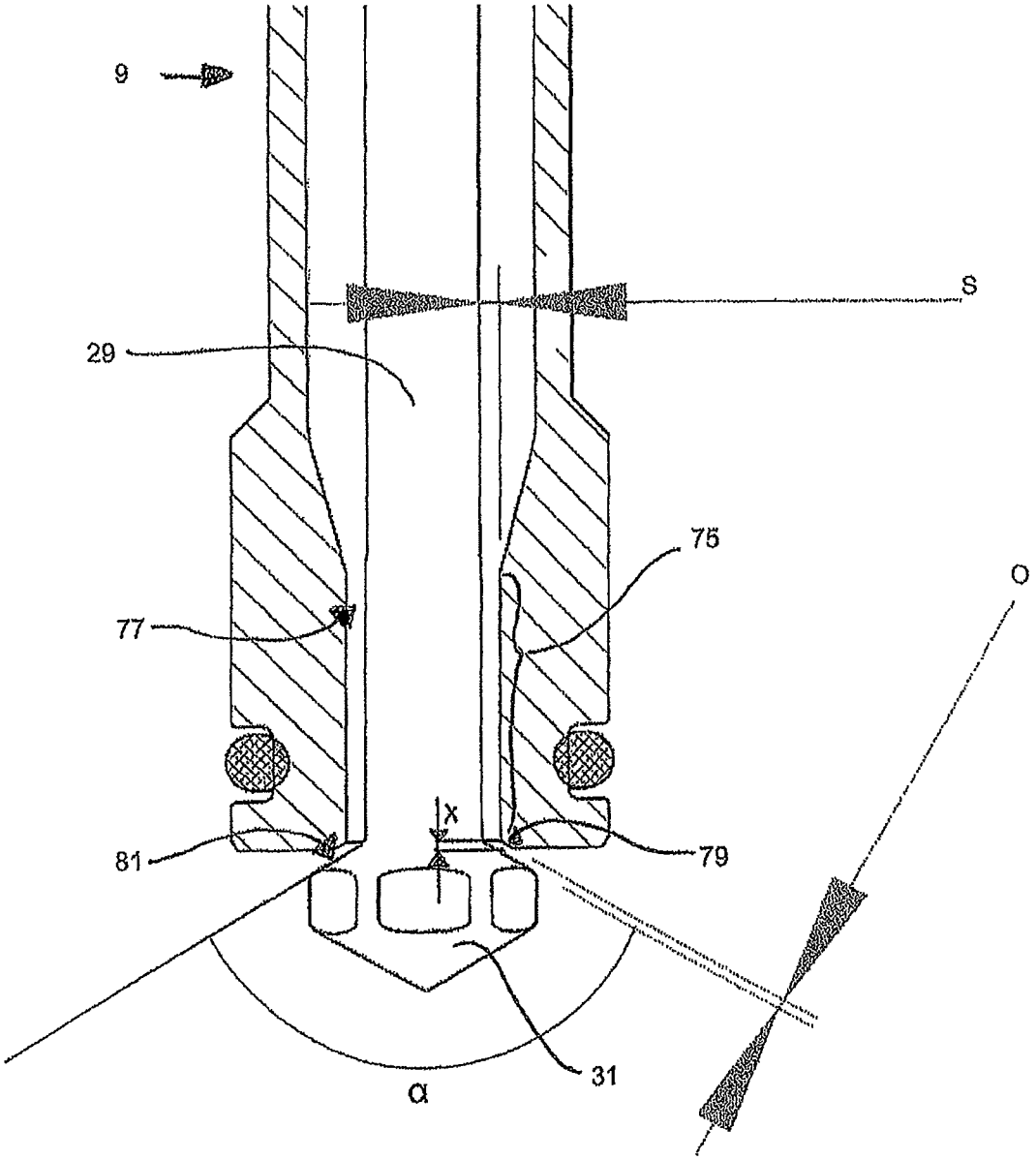

The invention is described in greater detail hereinafter by means of preferred embodiments and with reference to the accompanying Figures in which:

FIG. 1 shows a perspective view of the dispensing module according to the invention in a preferred embodiment, FIG. 2 shows a partly sectional side view of the dispensing module of FIG. 1, FIG. 3 shows a view on an enlarged scale of a part of the structure shown in FIG. 2, FIG. 4 shows a further detail view of the structure of FIG. 2, and FIG. 5 shows a detail view on an enlarged scale of the structure in FIGS. 2 and 4.

FIG. 1 shows a dispensing module 1. The dispensing module 1 has an actuator 3 which in the present example is in the form of a solenoid valve. The actuator 3 is connected to a module housing 5 of the dispensing module 1. The dispensing module 1 also has an adapter 7 connected to the module housing 5. A nozzle holder 9 is connected to the adapter 7 of the dispensing module 1.

Provided on the actuator 3 is a connector socket 19 having an electrical connection 11 for the feed of electric energy for controlling the actuator 3. In the present embodiment the module housing 5 is of a two-part structure. In this embodiment the two-part module housing has a cylinder housing 13 and a housing cover 15. A sound damper 17 is provided in the housing cover 15. It is screwed into the housing cover 15 of the module housing.

FIG. 2 shows a side view of the dispensing module 1 of FIG. 1. In regard to repeated references attention is directed to the description relating to FIG. 1. That also applies to the other Figures and references which are repeated therein. A part of the dispensing module 1 in FIG. 2 is shown as a sectional view. In particular the Figure shows that arranged between the actuator 3 and the housing cover 15 is an insulating plate 21, by means of which the actuator is connected to the module housing 5 or optionally the housing cover 15. Provided between the insulating plate 21 and the module housing 5 is a sealing element 35 which is in the form of a sealing plate and which extends around a multiplicity of bores. Alternatively, respective individual sealing elements could be provided here, but for reasons of manufacture and assembly it is deemed to be preferable to provide an individual sealing element which seals off those multiplicity of bores. Provided within the cylinder housing 13 are a first conduit 23 for a control fluid, for example air, and a second conduit 25 for a control fluid, for example air. By means of those conduits 23, 25 the dispensing module 1 is adapted to move a valve piston 33. The valve piston is accommodated within the module housing, in particular in a cylindrical portion of the cylinder housing 13. See in that respect also FIG. 3. The valve control of such valves is generally known so that for the sake of clarity there will not be a detailed description here relating to control of the fluid in the conduits 23, 25 by means of the actuator 3.

The adapter 7 has a plurality of recesses 27 which mutually cross and each extend completely through the adapter 7. In that way a valve stem 29 of the valve body is visible from the exterior. In addition the recesses 27 are to be used for assembly purposes. The adapter 7 is screwed to the module housing 5, in particular to the cylinder housing 13 of the module housing 5, see in that respect FIG. 3.

The nozzle holder 9 is also screwed to the adapter 7. The valve stem 29 of the valve body extends through the adapter 7 and the nozzle holder 9. At its proximal end the valve body has a valve head 31.

The enlarged view in FIG. 3 showing a first region of the sectional view of the portion shown in FIG. 2 of the dispensing module 1 substantially shows the distal part of the valve arrangement. The valve piston 33 is movable without play in a cylindrical portion 37 within the cylinder housing 13. A return means 39 preferably in the form of a spring holds the valve body in a normally closed position (NC). In that position of the valve piston 33 the valve head 31 (see FIG. 2 and FIG. 4) is in a closed position relative to the valve seat (see FIG. 4). The valve stem 29 has a threaded portion forming a screw connection 38 to a corresponding threaded portion in the valve piston 33. The valve stem 29 is fixedly connected to the valve piston 33 by means of a lock nut 41 and the screw connection 38. Optionally the thread of the screw connection 38 has a reduced pitch.

At a distal end 41 of the adapter 7 the latter is connected to the module housing 5, in particular the cylinder housing 13, by means of a screw connection 43. At the distal end 41 the adapter 7 has a positioning element 45 in the form of a centering shoulder. In the assembled condition shown in FIG. 3 the positioning element 45 co-operates with a positioning element 47, in the form of a centering bore, of the module housing 5, in particular the cylinder housing 13. In that way the adapter 7 is connected to the module housing 5 free of play and in a definitely positioned relationship.

The adapter 7 further has a proximal end 49 at which the adapter 7 and the nozzle holder 9 are connected by means of a screw connection 51. In the region of the proximal end 49, the adapter also has a positioning element 53 in the form of a centering shoulder and co-operating with a corresponding positioning element 55 in the form of a centering bore in the nozzle holder 9. At its peripheral surface the nozzle holder has a plurality of blind holes 63. The blind holes 63 are adapted for accommodating corresponding engagement elements of an assembly and disassembly tool, for example an assembly wrench.

As sealing means, the nozzle holder 9 has a first O-ring 57 and a second O-ring 59 arranged along the periphery of the nozzle holder. In addition, in a preferred embodiment the nozzle holder 9 has an axial sealing element 61 which is in contact with a corresponding surface of the adapter 7 and the nozzle holder 9. Alternatively the nozzle holder may comprise a flange-like end portion, at the surface of which the axial sealing element is correspondingly arranged. It will be noted however that a corresponding surface of the adapter 7 is provided for that purpose in the embodiment of FIG. 3. In addition, in the embodiment of FIG. 3 there is a seal receiving means 65 which permits a simplified arrangement of a radial sealing element. It is pushed into the region of the seal receiving means 65 and positioned and supported by assembly of the nozzle holder 9.

As regards FIGS. 3, 4 and 5, reference is made to the foregoing description with respect to repeated reference signs. FIG. 4 shows a further region of the dispensing module 1 shown in cross section in FIG. 2. FIG. 4 shows in particular details relating to the nozzle holder 9 of the dispensing module 1. The nozzle holder 9 comprises one or more feed openings 67 for the fluid to be dispensed. Provided within the nozzle holder 9 is a cavity 69 for transport of the fluid fed through the feed opening 67. The cavity comprises a first portion 71. In a preferred embodiment an enlarged cross-section is provided in the portion 71. In addition in a further preferred embodiment the valve stem 29 is narrowed in the region 71. Furthermore the cavity comprises a portion 73 of reduced cross-section. Because of the reduction in cross-section in the portion 73 the nozzle holder 9 comprises an elongate region 75. A narrow gap 77 is formed in that elongate region 75. In a preferred alternative the cross-section is not reduced in the portion 73, but the diameter of the valve stem 29 is increased so that this alternative also affords an elongate region with a narrow gap. In a further preferred alternative both the cross-section in the portion 73 is reduced and also the diameter of the valve stem 29 is increased.

Provided at the proximal end of the nozzle holder 9 is a valve seat 79 which in the operative position shown in FIG. 4 is in fluid-tight contact with a contact surface 81 of the valve head 31. In that condition this is referred to as the closed position. The valve head 31 substantially comprises a mushroom-type shape.

FIG. 5, in contrast to FIG. 4, shows the valve in an open position. The valve head 31 has been moved from the closed position into the open position by a stroke X together with the valve stem 29 and the valve piston 33 (not shown). FIG. 5 once again emphasizes the elongate region 75, the length of which is a multiple of the width of the narrow gap 77. The contact surface 81 of the valve head 31 is of a substantially conical configuration, the cone comprising an aperture angle α. In FIG. 5 the aperture angle α is about 120°. An opening of an internal width O has been cleared by movement of the valve head 31 by the stroke X into the open position. In the example shown in FIG. 5, the internal width O is less than a width S of the gap 77. Preferably, the internal width O is half as great as the width of the gap S. Further preferably the internal width O is 0.6 times the gap S and particularly preferably the internal width O is less than the width of the gap S. In the FIG. 5 embodiment the length of the elongate region 75 is approximately 15 times as great as the width S of the narrow gap 77.

The invention claimed is:

1. A dispensing module for use with an applicator head having a base member with a recess for dispensing hot-melt adhesive, the dispensing module comprising:

a module housing;

a valve body having a valve stem terminating in a valve head;

an adapter through which said valve body extends and having a proximal end and a distal end, said distal end being connected to said module housing;

a nozzle holder configured to be inserted into the recess in the base member of the applicator head; and one or more sealing elements for sealing said nozzle holder and the base member against each other in a fluid-tight manner, wherein said nozzle holder comprises:

a cavity through which said valve body extends, wherein said nozzle holder is connected to said proximal end of said adapter, said cavity comprising a first portion having a first enlarged cross-section and a second portion having a second reduced cross-section, said second reduced cross-section being smaller than said first enlarged cross-section, and said second portion further having a length over which the second portion's second reduced cross-section is constant, a valve seat configured to cooperate with said valve head of said valve body, wherein the amount of fluid passing between said valve seat and said valve head depends on the pressure drop produced by opening said valve seat and said valve head, and an elongate section, having a length and positioned upstream from said valve seat, wherein, along said length of said elongate section, said second portion of the cavity with the second reduced cross-section forms a narrow gap, said narrow gap having a width such that the pressure drop already occurs when said hot-melt adhesive is flowing through said narrow gap, and said length of said elongate section is a multiple greater than one of said width of said narrow gap, wherein said valve stem has a constant cross-section along its axial length overlapping with said second portion of the cavity, and wherein said valve body is movable to an open position when said valve head is moved away from said valve seat in a downward direction.

2. The dispensing module according to claim 1, in which said length of said elongate section is in a range of 14 to 20 times said width of said narrow gap.

3. The dispensing module according to claim 2, wherein said width of said narrow gap is in a range between 0.3 mm and 0.5 mm.

4. The dispensing module according to claim 1, wherein said elongate section is disposed adjacent to said valve seat.

5. The dispensing module according to claim 1, wherein said valve body is movable between a closed position in which said valve head is in fluid-tight contact with said valve seat, and said open position, said closed position and said open position being spaced apart from each other by a stroke, and the orifice, which is released by means of the stroke, being larger than that of the said narrow gap.

6. The dispensing module according to claim 1, wherein said valve seat comprises a seat surface having an aperture angle in the range between 120° and 140°.

7. The dispensing module according to claim 6, wherein said valve head comprises a surface matching said seat surface of the valve seat and having an aperture angle between 115° and 140°.

8. The dispensing module according to claim 1, wherein said adapter comprises a positioning element at said distal end and said module housing comprises a matching positioning element.

9. The dispensing module according to claim 8, wherein said adapter comprises a positioning element at said proximal end and said nozzle holder comprises a matching positioning element.

10. The dispensing module according to claim 1, wherein said elongate section is adjacent to said valve seat.

* * * * *